US011946265B2

(12) United States Patent
Baron et al.

(10) Patent No.: US 11,946,265 B2
(45) Date of Patent: Apr. 2, 2024

(54) FORMWORK FRAME, FORMWORK ELEMENT, CEILING FORMWORK AND METHOD

(71) Applicant: DOKA GMBH, Amstetten (AT)

(72) Inventors: Christoph Baron, Amstetten (AT); Philipp Schagerl, Amstetten (AT)

(73) Assignee: DOKA GMBH, Amstetten (AT)

( * ) Notice: Subject to any disclaimer, the term of this patent is extended or adjusted under 35 U.S.C. 154(b) by 330 days.

(21) Appl. No.: 17/434,394

(22) PCT Filed: Feb. 26, 2020

(86) PCT No.: PCT/EP2020/054958
§ 371 (c)(1),
(2) Date: Aug. 26, 2021

(87) PCT Pub. No.: WO2020/173972
PCT Pub. Date: Sep. 3, 2020

(65) Prior Publication Data

US 2022/0145648 A1 May 12, 2022

(30) Foreign Application Priority Data

Feb. 27, 2019 (EP) ..... 19159607

(51) Int. Cl.
*E04G 11/52* (2006.01)
*E04G 11/38* (2006.01)
*E04G 11/48* (2006.01)

(52) U.S. Cl.
CPC ..... *E04G 11/52* (2013.01); *E04G 11/38* (2013.01); *E04G 11/483* (2013.01)

(58) Field of Classification Search
CPC ..... E04G 11/38; E04G 11/48; E04G 11/483; E04G 11/486; E04G 11/50; E04G 11/52;
(Continued)

(56) References Cited

U.S. PATENT DOCUMENTS 3,784,151 A 1/1974 Steele
8,276,874 B2 * 10/2012 Schwoerer ..... E04G 11/52 249/210

(Continued)

FOREIGN PATENT DOCUMENTS

CA 2803395 A1 * 7/2014 ..... E04G 11/38
CA 3068904 A1 2/2019

(Continued)

OTHER PUBLICATIONS

ISA European Patent Office, International Search Report Issued in Application No. PCT/EP2020/054958, dated May 8, 2020, WIPO, 4 pages.

(Continued)

*Primary Examiner* — Rodney Mintz
(74) *Attorney, Agent, or Firm* — McCoy Russell LLP

(57) ABSTRACT

The invention relates to a formwork frame for a formwork element of a ceiling formwork, comprising: a first cross-support; a second cross-support; a connecting piece which is longer in comparison to the first and second cross-support, which is arranged substantially perpendicular to the first and second cross-support, and which connects the first cross-support to the second cross-support; a first lateral recess on the one longitudinal side of the formwork frame; and a second lateral recess on the other longitudinal side of the formwork frame.

12 Claims, 16 Drawing Sheets

(58) Field of Classification Search
CPC ..... E04G 2025/003; E04B 5/17; E04B 5/32; E04B 5/36
See application file for complete search history.

(56) References Cited

U.S. PATENT DOCUMENTS

| | | | | |
|---|---|---|---|---|
| 8,366,068 | B2 * | 2/2013 | Schmied | E04G 1/14 52/127.2 |
| 8,523,137 | B2 * | 9/2013 | Schworer | E04G 11/483 249/18 |
| 11,149,434 | B2 * | 10/2021 | Baron | E04G 11/48 |
| 11,473,320 | B2 * | 10/2022 | Schneider | E04G 11/48 |
| 2008/0001049 | A1 | 1/2008 | Schmied | |
| 2009/0211195 | A1 * | 8/2009 | Schwoerer | E04G 11/52 52/692 |
| 2009/0250589 | A1 * | 10/2009 | Schworer | E04G 11/483 249/192 |
| 2019/0161982 | A1 * | 5/2019 | Schneider | E04G 11/36 |
| 2020/0232213 | A1 * | 7/2020 | Baron | E04G 11/48 |

FOREIGN PATENT DOCUMENTS

| | | | | |
|---|---|---|---|---|
| DE | 202006003836 | U1 * | 7/2006 | E04G 11/38 |
| DE | 102007021159 | A1 | 11/2008 | |
| EP | 1059402 | A1 | 12/2000 | |
| EP | 3121349 | A1 * | 1/2017 | E04G 11/36 |
| EP | 3202998 | A1 | 8/2017 | |
| FR | 1381954 | A | 12/1964 | |
| FR | 2136813 | A5 | 12/1972 | |
| JP | H0512544 | U | 2/1993 | |
| WO | WO-2007003400 | A1 * | 1/2007 | E04G 11/483 |
| WO | 2018007420 | A1 | 1/2018 | |
| WO | 2019025513 | A1 | 2/2019 | |

OTHER PUBLICATIONS

Canadian Intellectual Property Office, Office Action Issued in Application No. 3,130,021, dated Sep. 12, 2023, 7 pages.

* cited by examiner

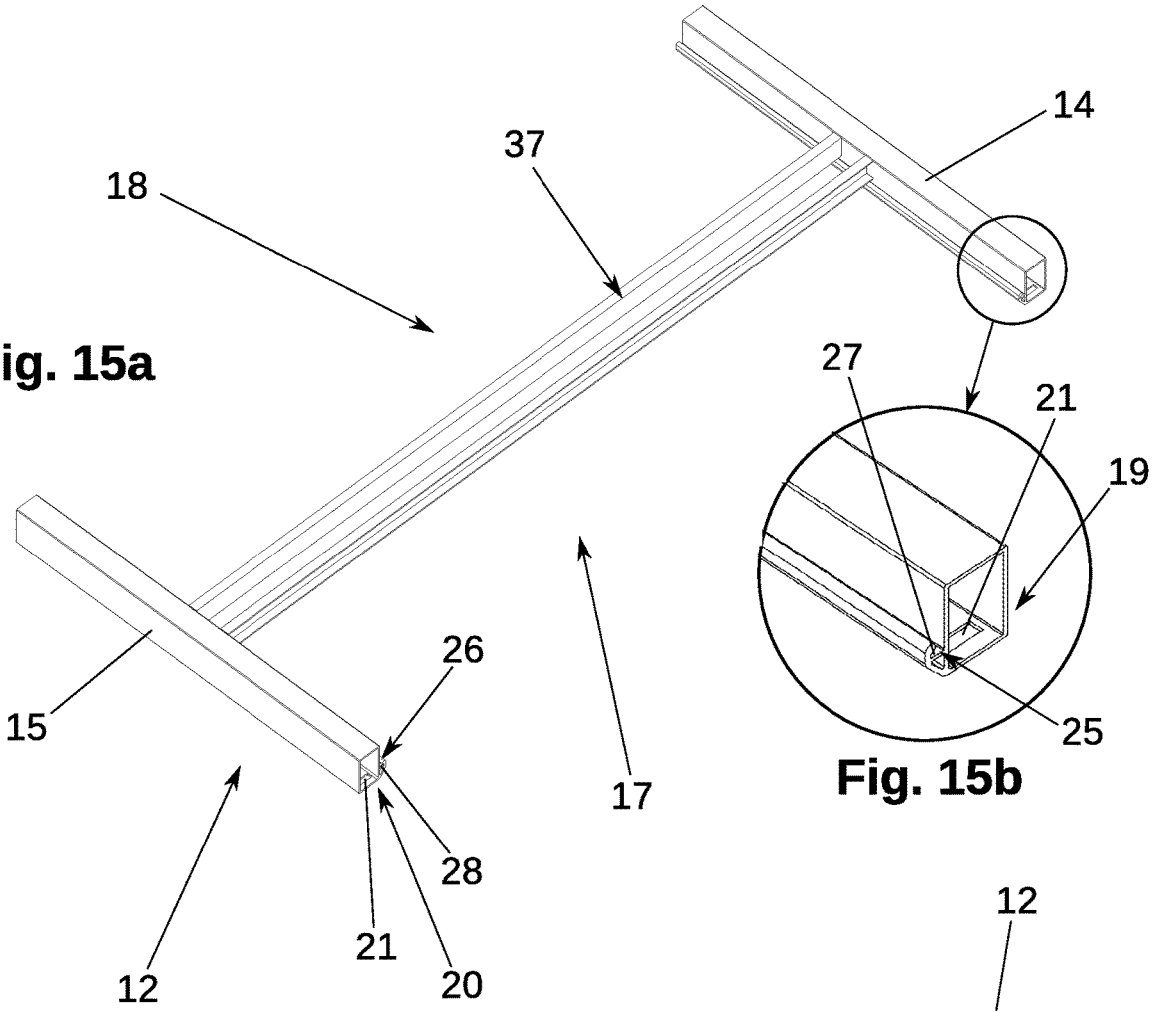
Fig. 15a
Fig. 15b
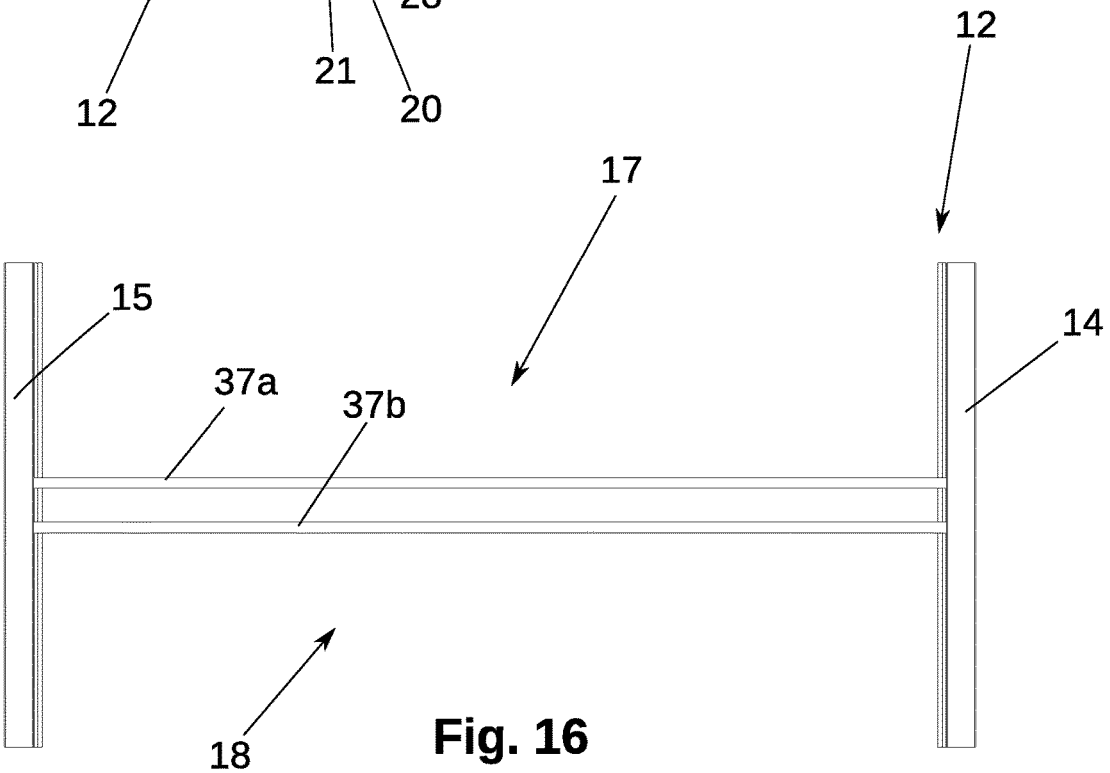
Fig. 16

FORMWORK FRAME, FORMWORK ELEMENT, CEILING FORMWORK AND METHOD

CROSS REFERENCE TO RELATED APPLICATIONS

The present application is a U.S. National Phase of International Application No. PCT/EP2020/054958 entitled "FORMWORK FRAME, FORMWORK ELEMENT, CEILING FORMWORK AND METHOD," and filed on Feb. 26, 2020. International Application No. PCT/EP2020/054958 claims priority to European Patent Application No. 19159607.1 filed on Feb. 27, 2019. The entire contents of each of the above-listed applications are hereby incorporated by reference for all purposes.

TECHNICAL FIELD

The invention relates to a formwork frame for a formwork element of a ceiling formwork. The invention also relates to a formwork element having such a formwork frame and to a ceiling formwork having the formwork element. Finally, the invention relates to a method for constructing such a ceiling formwork.

BACKGROUND AND SUMMARY

WO 2018/07420 A1 discloses an equalisation element for closing a gap in a ceiling formwork which has multiple standard formwork elements with a closed frame around the periphery. If the building of the ceiling formwork is impeded by an obstacle in the form of a pillar, the equalisation element can be hooked into the formwork props from the floor using a U-shaped frame such that the pillar is accommodated inside the U-shaped frame. The U-frame is then swung up from below and provided with two further props. A second U-shaped frame is then mounted from below to obtain a closed frame. The equalisation element therefore allows the pillar to be built around. In this prior art, the U-frame is hooked into the formwork props from the floor. However, owing to the U-shape of the frame, it is necessary to attach the formwork lining and additional formwork supports to the frame after it has been swung up.

A similar formwork is disclosed in DE 10 2007 021 159 A1, but the construction thereof is likewise laborious.

WO 2019/025513 A1 discloses a ceiling formwork with a permanent formwork board. However, this prior art is not suitable for building around an obstacle.

Formwork systems are also known from EP 1 059 402 A1, JP H05 12544 U, FR 1 381 954 A, EP 3 202 998 A1 and FR 2 136 813 A5.

Accordingly, the object of the present invention consists in moderating or overcoming at least some disadvantages of the prior art. The invention is aimed in particular at creating a formwork frame which allows many different uses, in particular building around obstacles in a ceiling formwork in a simple and safe manner.

This object is achieved by a formwork frame, a formwork element, a ceiling formwork, and a method, embodiments of which are specified herein.

According to the invention, a formwork frame is provided, which has:

- a first cross-support,
- a second cross-support,
- a connecting piece which is longer than the first cross-support and the second cross-support, is arranged substantially perpendicular to the first cross-support and the second cross-support, and connects the first cross-support to the second cross-support,
- a first lateral recess on one longitudinal side of the formwork frame, and
- a second lateral recess on the other longitudinal side of the formwork frame.

A formwork frame of I-shaped outline is thus obtained, which has a number of advantages for a ceiling formwork. An "I-shaped" formwork is understood to mean a formwork frame which permanently has an I-shape or has a defined concreting position with an I-shape. Firstly, an obstacle such as a pillar can be received on both longitudinal sides of the formwork frame, specifically inside the first recess or inside the second recess. Preferably, the first and second recesses have substantially the same extent parallel to the formwork lining plane. It is thus made much easier to build around obstacles in comparison with the prior art. Owing to the recesses on the opposing longitudinal sides of the formwork frame, it is possible to build around even relatively large obstacles by receiving the obstacle in two adjacent lateral recesses of two formwork frames mounted next to each other. It is also advantageous that the formwork frame has a first cross-support and a second cross-support, which are shorter than the connecting piece. During use, the first cross-support is first hooked into the two first formwork props such that the formwork frame is arranged in an intermediate position inclined obliquely downwards along the connecting piece from the first cross-support. Since the connecting piece is longer than the first and second cross-supports, the second cross-support is close to the floor when in the intermediate position, so that at least one further element, such as a panel element and/or a longitudinal support, in particular with a formwork board also held detachably thereon, can be arranged on the formwork frame when it is still in the intermediate position. In this manner, a formwork element is obtained which can be swung up as a whole from the intermediate position into the preferably substantially horizontal use and concreting position. The first and second cross-supports therefore allow the formwork elements to be attached already in the intermediate position, as a result of which the safety while building around the obstacle is considerably increased.

Preferably, the first and second cross-supports and the connecting piece are produced from metal.

According to a particularly preferred embodiment, the first cross-support has a first receptacle and/or the second cross-support has a second receptacle for detachable connection to a further element, in particular a longitudinal support and/or a panel element, of the formwork element in an intermediate position of the formwork frame inclined downwards from the first cross-support along the connecting piece in the direction of the second cross-support. In this embodiment, the formwork element can be connected detachably to at least one further element, in particular a longitudinal support or a panel element, from the floor. Preferably, a first interlocking connection, in particular a first hook, bolt or latch connection, is provided between the further element and the first receptacle of the first cross-support, and/or a second interlocking connection, in particular a second hook, bolt or latch connection, is provided between the further element and the second receptacle of the second cross-support. It is particularly preferred if the further element, i.e. in particular the panel element or the longitudinal support, is detachably connected to both the first receptacle and the second receptacle. When the ceiling formwork is constructed, the formwork frame is first arranged in the intermediate position inclined obliquely downwards, in which only the first cross-support of the formwork frame is connected to two first formwork props but there are no formwork props under the second cross-support. Owing to the connecting piece, the second cross-support is in the inclined intermediate position close to the floor, so that the further element can simply be hooked into the formwork frame from the floor. The first and/or second receptacle is designed to hold the further element in the inclined intermediate position independently, i.e. without aids and without manual support, on the formwork frame. The further element can thus be fixed on the formwork frame already in the intermediate position, before the formwork frame together with the longitudinal support or panel element arranged thereon is swung up into the use position and two second formwork props are placed under it. The construction of the ceiling formwork can thus be made particularly simple and safe.

To allow the independent attachment of the further element in the oblique position of the formwork frame, it is favourable if the first receptacle has a first receiving groove and/or the second receptacle has a second receiving groove. In this embodiment, the further element has, at opposing ends, corresponding hook elements which can be connected to the first and second receiving grooves of the formwork frame. Preferably, the first receiving groove extends substantially in the direction of the longitudinal axis of the first cross-support (i.e. in the transverse direction of the formwork frame). The second receiving groove preferably extends substantially in the direction of the longitudinal axis of the second cross-support (i.e. likewise in the transverse direction of the formwork frame). Preferably, the first and second receiving groove, respectively, extends over more than a quarter, preferably over more than half, in particular over more than three quarters, of the length of the first and second cross-support, respectively. A high level of flexibility when arranging further elements such as longitudinal supports and/or panel elements is achieved thereby. The same I-shaped formwork frame can thus be equipped with longitudinal supports or with panel elements depending on the application.

In a preferred embodiment, for secure arrangement of the longitudinal support or panel element in the inclined intermediate position, the first receiving groove has a first undercut and/or the second receiving groove has a second undercut for engagement with a hook element of the longitudinal support and/or a hook element of the panel element. The engagement of the hook element on the longitudinal support or panel element in the first or second receiving groove produces a form fit, which prevents unintentional detachment of the longitudinal support or panel element irrespective of the forces effective in the intermediate position, without the workers themselves having to hold the longitudinal support or the panel element in the intermediate position and while the formwork frame is swung up.

In a further embodiment, the first receptacle has first receiving points at defined intervals in the longitudinal direction of the first cross-support, and/or the second receptacle has second receiving points at defined intervals in the longitudinal direction of the second cross-support.

To construct the ceiling formwork, it is favourable if the first cross-support has a first retainer and/or the second cross-support has a second retainer for detachable connection to a formwork prop. Preferably, the first and second cross-supports have two first and second retainers, respectively, in particular at opposing ends for detachable connection to two first and second formwork props, respectively.

When the ceiling formwork is constructed, the first retainers on the first cross-support are brought into engagement with the first formwork props, as a result of which the formwork element is arranged in the intermediate position inclined downwards from the first cross-support towards the second cross-support. After swinging up, the second retainers on the second cross-support are brought into engagement with the second formwork props, so that the formwork element is arranged in the intended concreting position. To this end, the first and second formwork props have engagement elements, in particular hooks, on the top, for example on a head part. Preferably, four engagement elements are provided per first and second formwork prop, in order to be able to attach up to four formwork elements to the same first or second formwork prop. The concreting position can be horizontal. However, a tilted position of the formwork element in the concreting position can also be provided by different first and second formwork props or different telescoping extents of the first and second formwork props. However, the angle of the formwork element relative to the horizontal in the concreting position is smaller than in the inclined intermediate position.

For connection to the formwork props, the first and/or second retainer of the formwork frame preferably has a retaining protrusion or a retaining opening. When the ceiling formwork is constructed, the retaining protrusion or the retaining opening is connected to a corresponding engagement element at the upper end of the formwork prop. Preferably, the first retainer and/or the second retainer has in each case two retaining protrusions or retaining openings to allow a connection of the first or second cross-support to two formwork props. The retaining opening can be formed by a cut-out in the first or second cross-support. The retaining protrusion can be in the form of a hook.

According to a preferred embodiment, the connecting piece is connected to the first and second cross-supports displaceably in the transverse direction. Preferably, transverse guides are provided on the first and second cross-supports and allow the transverse displacement of the connecting piece. In this embodiment, the connecting piece in the basic position is substantially equally far away from both longitudinal ends of the formwork frame (i.e. from the ends of the first and second cross-supports), resulting in an I-shape of the formwork frame outline. Starting from the basic position, the connecting piece can be shifted towards one longitudinal side and/or the other longitudinal side of the formwork frame in order to enlarge the first or second recess for receiving an obstacle, such as a prop, correspondingly.

In some applications, it is also advantageous if the connecting piece is formed by a double piece. The double piece has two piece elements, the opposing ends of which are connected to the first and second cross-supports, respectively. In this manner, an additional stiffening of the formwork frame is advantageously achieved.

In a preferred application, at least one panel element is arranged on the formwork frame, preferably exactly two identical panel elements being arranged to form a rectangular formwork top on the formwork frame. Preferably, the panel element has a formwork lining, which delimits the formwork space, on the top. On the underside, the panel element preferably has at least one strut, preferably two struts being arranged parallel and at a distance from each other on the underside of the panel element. According to a preferred embodiment, the strut has, on each of the two opposing longitudinal ends, a hook element, which can be connected detachably to the first or second receptacle on the formwork frame.

For the purposes of this disclosure, a "detachable" connection means that the connection can be made and undone again, in particular without tools, to allow further uses of the connected components.

In an alternative embodiment of the formwork element, at least one longitudinal support is arranged on the formwork frame, preferably at least one longitudinal support on each side of the connecting piece, to support a formwork board.

The formwork element is preferably used in a ceiling formwork in which the first cross-support of the formwork frame is supported on two first ceiling props, and the second cross-support of the formwork frame is supported on two second ceiling props. The first and second formwork props are preferably formed by telescopic props.

In one of the above-described variants, the ceiling formwork can be extended by at least one further formwork element, in which case two third ceiling props are provided. Preferably, two adjacent formwork elements share two formwork props.

According to the invention, the following method can be carried out to construct the ceiling formwork to produce a ceiling element:

arranging two first ceiling props on a floor, providing a formwork frame, connecting the first cross-support of the formwork frame of the formwork element to the two first ceiling props, the formwork frame of the formwork element being arranged in an intermediate position inclined downwards from the first cross-support along the connecting piece in the direction of the second cross-support, arranging at least one further element, in particular a panel element and/or a longitudinal support, on the formwork frame in the intermediate position to obtain a formwork element;

swinging the formwork element up from the intermediate position into a preferably substantially horizontal use position, and supporting the second cross-support of the formwork frame of the formwork element with two second ceiling props.

Accordingly, at least one further formwork element can be mounted, in which case the formwork frame of the further formwork element is likewise initially connected to two formwork props in an inclined intermediate position, then the further element is arranged on the formwork frame still in the intermediate position, and finally the further formwork element thus produced is swung up into the concreting position. Preferably, two adjacent formwork elements share two formwork props.

In a preferred application, when the formwork element is arranged in the intermediate position, an obstacle, in particular a pillar, is arranged within the first or second lateral recess of the formwork element. As described above, the I-shaped formwork frame is provided, while still in the intermediate position, with at least one further element, in particular with a longitudinal support for supporting formwork boards or with a panel element having a planar formwork surface. Then, the formwork element thus formed is swung up into the concreting position. In the case of the longitudinal supports, they can likewise be connected to formwork boards while still in the intermediate position.

BRIEF DESCRIPTION OF THE FIGURES

The invention is explained in more detail below using an exemplary embodiment shown in the drawings.

FIGS. 15*a*, 15*b* and 16 each show a further I-frame according to the invention which, in this variant, has a second connecting piece to form a double piece.

DETAILED DESCRIPTION

FIGS. 1 to 4 show the construction of a ceiling formwork 1 to produce a ceiling or floor element by pouring concrete on the ceiling formwork 1.

Figure 1:
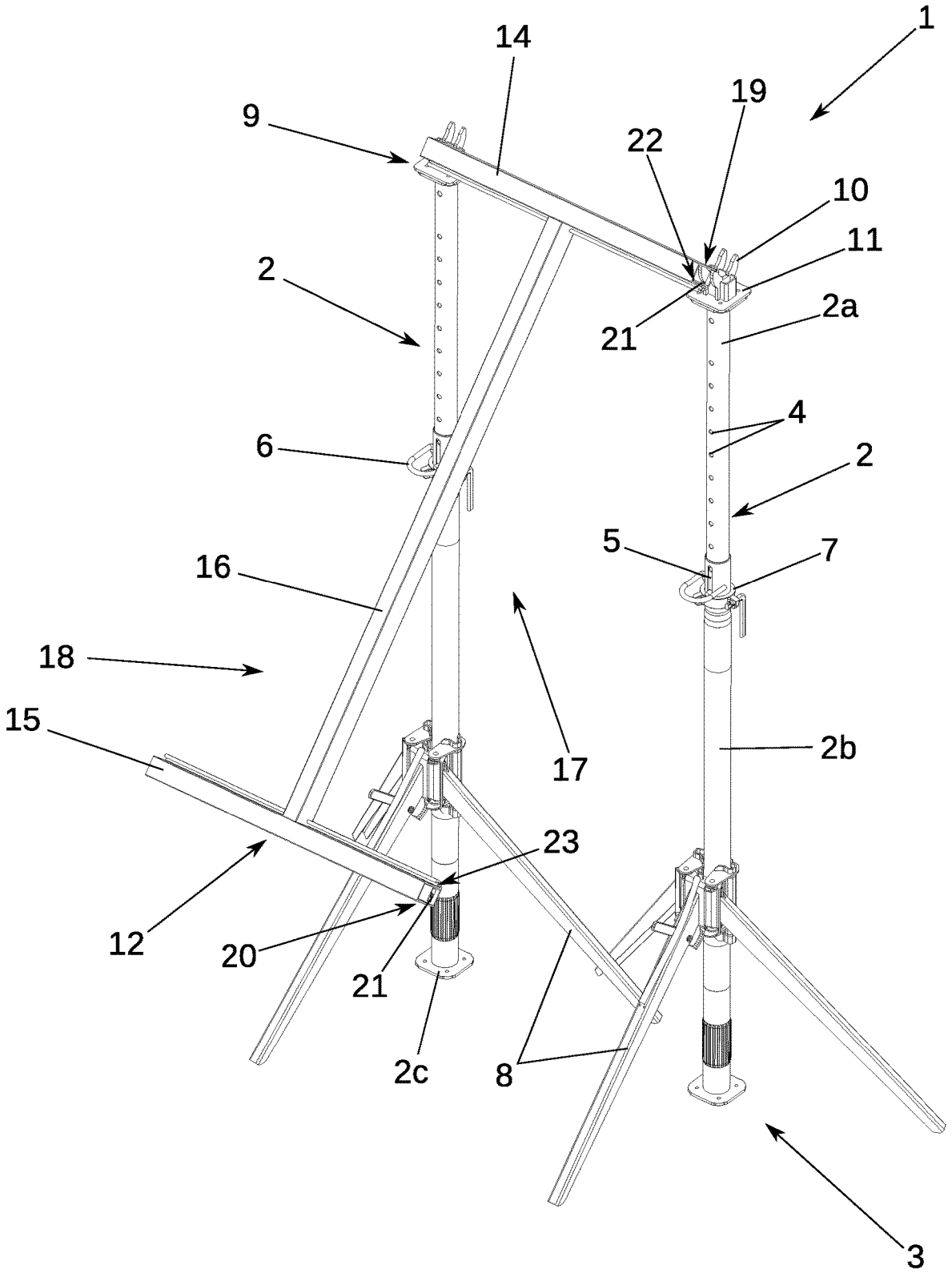
FIGS. 1 to 4 show the construction of a ceiling formwork according to the invention, in which first an I-frame is attached to two formwork props (FIG. 1), two panel elements are hooked in while the I-frame is still in an inclined intermediate position (FIGS. 2*a* and 2*b*), before the formwork element formed of the I-frame and the panel elements is swung up into a horizontal concreting position (FIG. 3) and is supported in the concreting position with two further formwork props (FIG. 4).

According to FIG. 1, two elongate formwork props 2 are arranged in a vertical supporting position on the floor 3. The formwork props 2 have a prop upper part 2*a* and a prop lower part 2*b*. The prop upper part 2*a* is arranged in a telescoping manner on the prop lower part 2*b*, which is supported on the floor 3 by means of a foot plate 2*c*. To set the desired length of the formwork prop 2, the prop upper part 2*a* has pairs of opposing through-openings 4 spaced from each other in the longitudinal direction, and the prop lower part 2*b* has opposing slots 5, through which a securing element 6, in this case a securing bolt, can be inserted. Furthermore, a union nut 7 is provided for fine adjustment of the vertical position. The formwork props 2 are stabilised on the floor 3 using prop legs 8. At the top, the formwork props 2 have a head part 9 with four engagement elements 10, which protrude upwards from a head plate 11 of the head part 9. The engagement elements 10 provided in the embodiment shown are hooks, but the engagement elements 10 can also be formed by lugs, profiles or grooves.

As can also be seen from FIG. 1, a formwork frame 12, which is I-shaped when viewed from above, is attached to the formwork prop 2. The formwork frame forms the base for a formwork element 13 (cf. FIG. 2*a*). The formwork frame 12 has a first cross-support 14, a second cross-support 15 and a connecting piece 16 arranged at right angles thereto. One end of the connecting piece 16 is connected to the first cross-support 14, the other end of the connecting piece 16 is connected to the second cross-support 15, in each case in a non-tilting and captive manner. The first cross-support 14, the second cross-support 15 and the connecting piece 16 are in the form of linear elements having distinct longitudinal axes. The connecting piece 16 has a longer length (i.e. a greater extent in the direction of the longitudinal axis) than both the first cross-support 14 and the second cross-support 15, which have substantially the same length. Preferably, the ratio between the length of the connecting piece 16 and the length of the first cross-support 14 or the second cross-support 15 is more than 1.5:1, preferably more than 2:1, but in particular less than 4:1. A first lateral recess 17 is formed on one longitudinal side (i.e. longer side) of the formwork frame 12, and a second lateral recess 18 is formed on the other longitudinal side of the formwork frame 12. The first lateral recess 17 extends from one longitudinal side of the connecting piece 16 to one end of the first cross-support 14 and the second cross-support 15. The second lateral recess 18 extends from the other outer side of the connecting piece 16 to the other end of the first cross-support 14 and the second cross-support 15. The first lateral recess 17 and the second lateral recess 18 thus each have the same length as the connecting piece 16. The width of the first lateral recess 17 and the second lateral recess 18 corresponds to the distance from the respective longitudinal side of the connecting piece 16 to the corresponding ends of the first cross-support 14 and the second cross-support 15. In the embodiment shown, the connecting piece 16 protrudes substantially from the middle of the first cross-support 14 and the second cross-support 15, in relation to the longitudinal extent thereof, so that the formwork frame 12 has an I-shaped outline (i.e. in the viewing direction perpendicular to the formwork lining plane).

As can also be seen in FIG. 1, the first cross-support 14 has a first retainer 19, and the second cross-support 15 has a second retainer 20, which are designed for detachable connection to the first formwork props 2. The formwork frame 12 can thus be hooked into the formwork prop 2 and removed therefrom again. In the embodiment shown, the first retainer 19 on the first cross-support 14 and the second retainer 20 on the second cross-support 15 each have a retaining opening 21, with which the engagement elements 10, in this case in the form of hooks, can be brought into engagement on the head parts 11 of the associated formwork props 2. The connection between the retaining openings 21 on the first cross-support 14 and the engagement elements 10 on the formwork props 2 is such that the formwork frame 12 is held independently, i.e. without support under the second cross-support 15 and without manual holding of the second cross-support 15, in the intermediate position according to FIG. 1, in which the formwork frame 12 is inclined obliquely downwards from the first cross-support 14 along the connecting piece 16 in the direction of the second cross-support 15. The I-frame can be arranged at an angle of 5° to 45°, in particular 10° to 40°, for example substantially 20°, to the longitudinal axis of the formwork props 2, that is, to the vertical. The second cross-support 15 can thereby be situated in the vicinity of the lower end of the formwork prop 2, that is, close to the floor 3. This makes it easier to complete the formwork element 13; cf. FIG. 2*a*. The first cross-support 14 also has a first receptacle 22, and the second cross-support 15 has a second receptacle 23, which is needed in the next step of constructing the ceiling formwork 1.

Figures 2A, 2B:
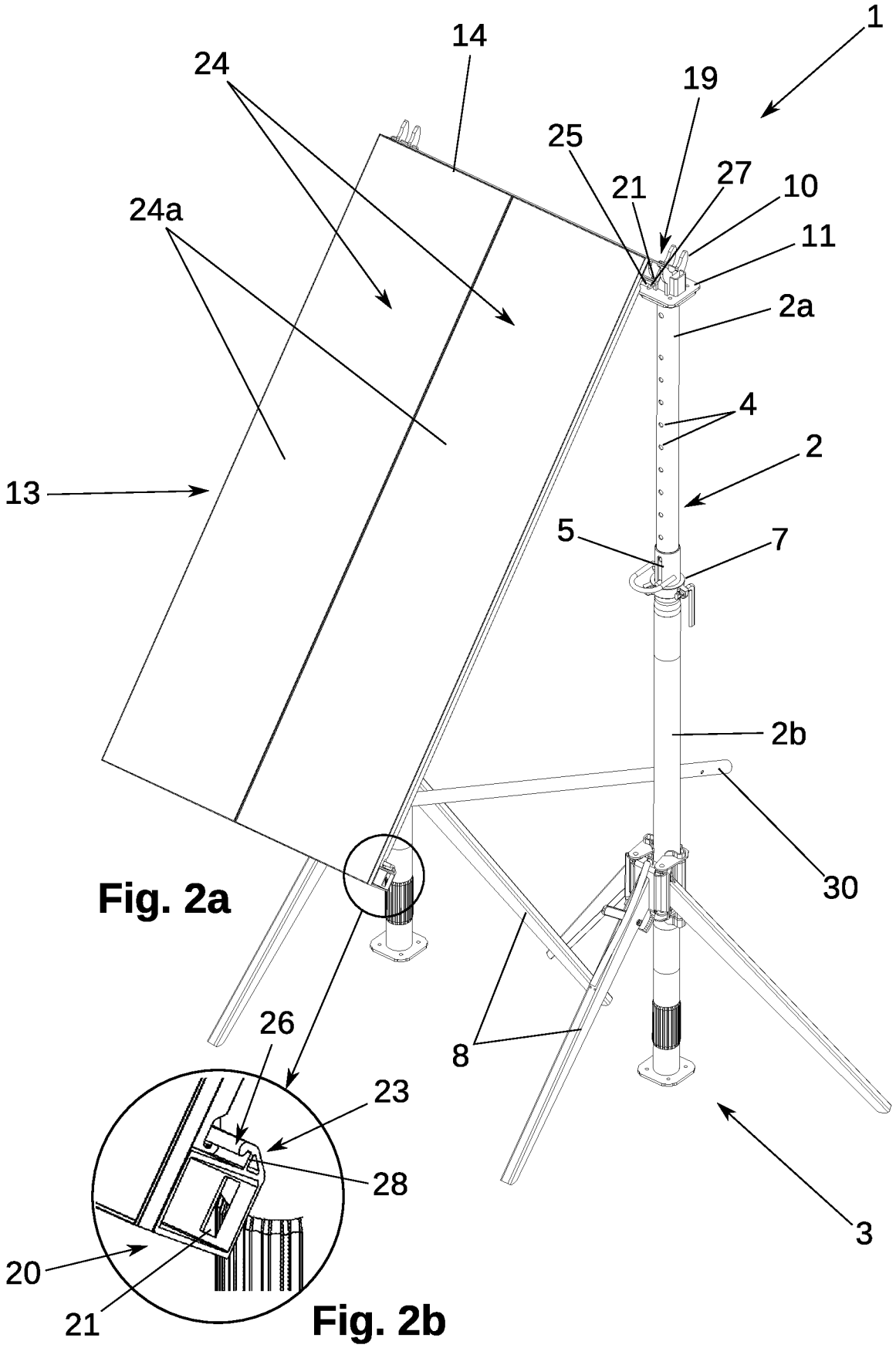

As can be seen in FIGS. 2*a* and 2*b*, the first receptacle 22 and the second receptacle 23 (cf. FIG. 13) are used to arrange panel elements 24 on the formwork frame 12 in order to form the formwork element 13. The panel element 24 has a panel 24*a*, the top of which forms the formwork lining, i.e. the surface in contact with the concrete. On the underside of the panel 24*a*, the panel element 24 has two longitudinal struts 24*b* (cf. FIG. 17). In the embodiment shown, the panel elements 24 are dimensioned such that exactly two identical panel elements 24 form a rectangular top or formwork lining corresponding to the external outline of the formwork frame 12. In the embodiment shown, the first receptacle 22 has a first receiving groove 25, which extends substantially in the direction of the longitudinal axis of the first cross-support 14. Correspondingly, the second receptacle 23 has a second receiving groove 26 (cf. in particular FIG. 2*b*), which extends substantially in the direction of the longitudinal axis of the second cross-support 15. The first receiving groove 25 has a first undercut 27, and the second receiving groove 26 has a second undercut 28 (cf. FIGS. 15*a* and 15*b*), into which hook elements 29 are hooked at the opposing ends of the longitudinal struts 24*b* of the panel element 24 (cf. FIG. 17).

Figure 3:
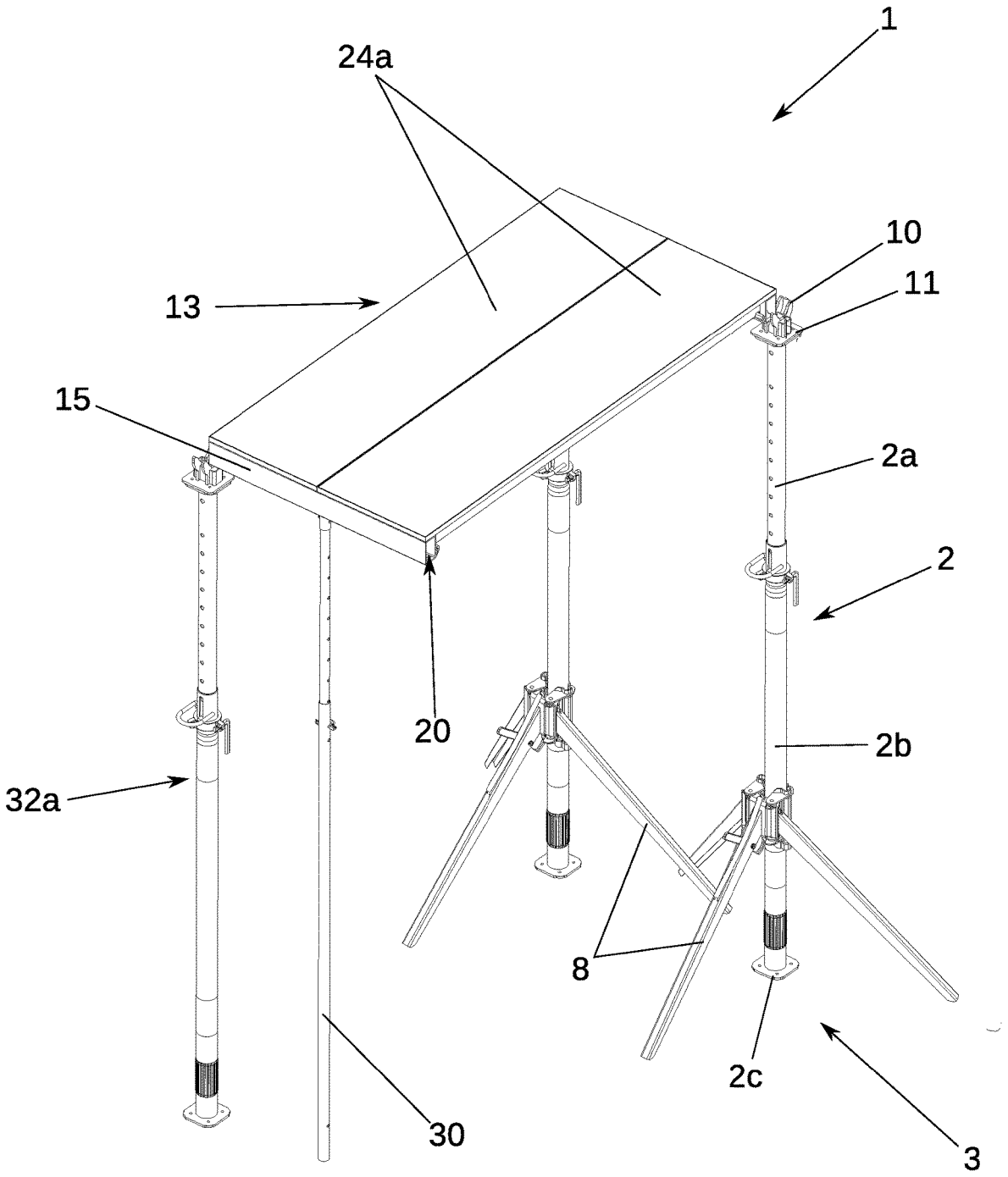

As can further be seen in FIG. 2*a*, a tool 30 in the form of a temporary prop is then brought into engagement with the second cross-support 15 of the formwork frame 12 in order to swing the formwork element 13 up from the intermediate position (FIG. 2*a*) into the horizontal use position (FIG. 3).

Figure 4:
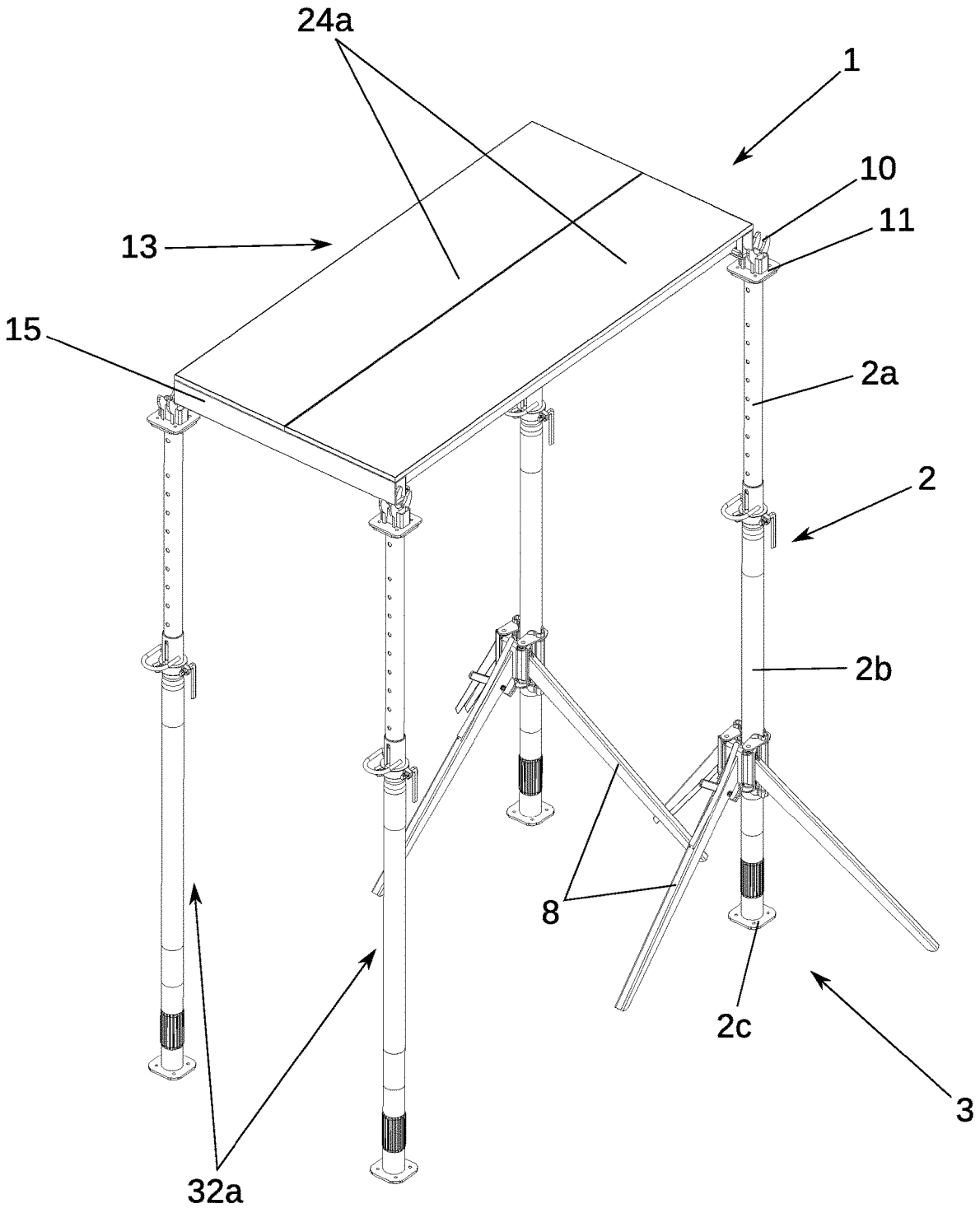

As can be seen in in FIGS. 3 and 4, the formwork element 13 is first supported in the use position by the temporary prop on the floor 3, before two second formwork props 32*a* are attached to the second cross-support 15. The temporary prop can be removed again.

Figure 5:
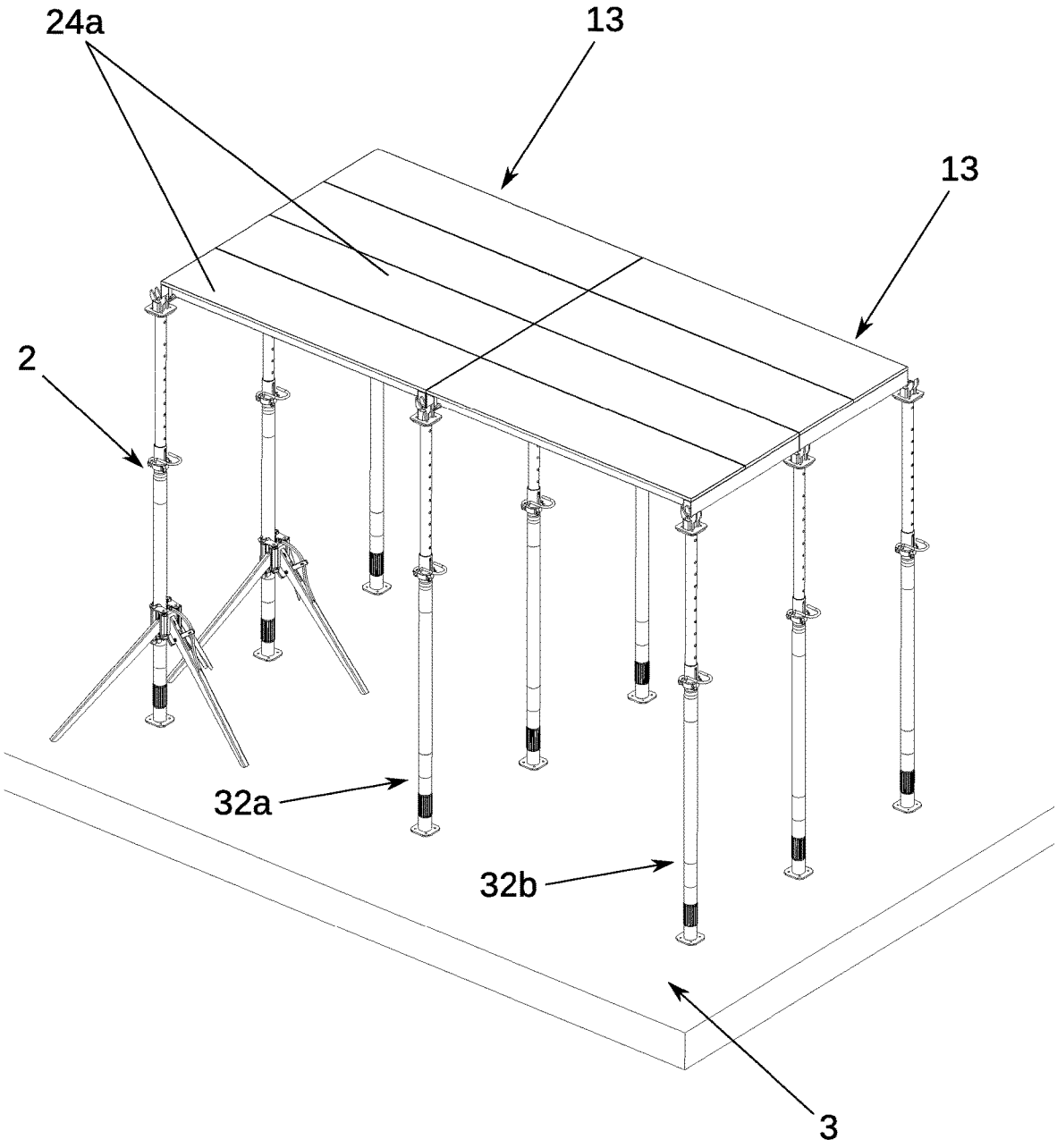
FIG. 5 shows a ceiling formwork having four formwork elements according to FIG. 4 in the concreting position, each formwork element being formed by an I-frame and two panel elements held in a reversibly detachable manner therein.

As can be seen in FIG. 5, further formwork elements 13 can be provided to obtain a ceiling formwork 1 having the desired horizontal extent of the formwork lining. Third formwork props 32*b* are provided for this. Two adjacent formwork elements 13 share two (first, second, third) formwork props 2, 32*a*, 32*b* in each case. Up to four formwork elements 13 can be attached to each formwork prop 2, 32*a*, 32*b* by means of the four engagement elements 10.

FIGS. 6 to 10 show an alternative embodiment; only the differences from FIGS. 1 to 5 are discussed below.

Figure 6:
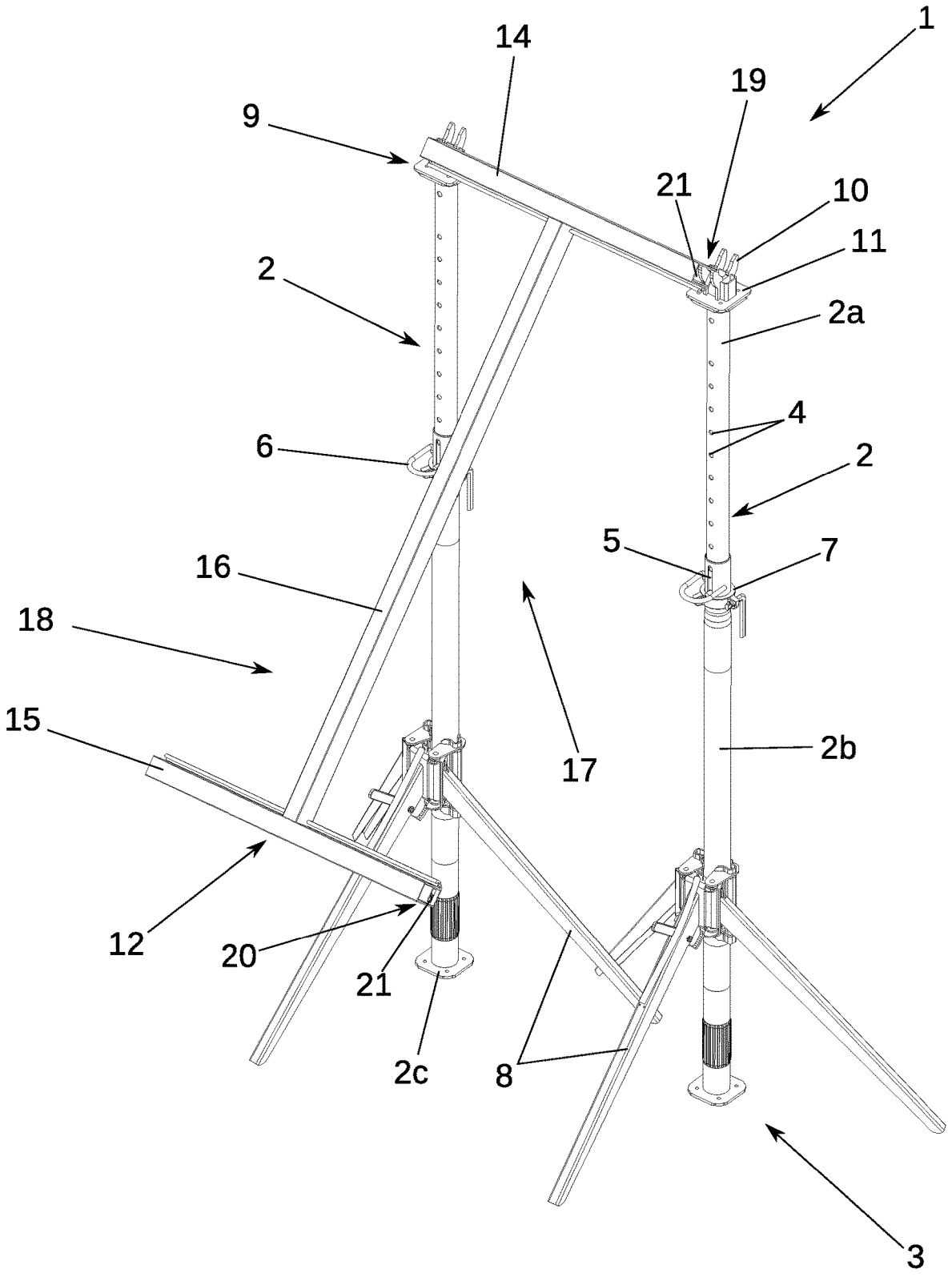
FIGS. 6 to 9 show, corresponding to FIGS. 1 to 4, the construction of a further ceiling formwork according to the invention, in which the I-frame is again attached to two formwork props in the oblique position (FIG. 6), multiple longitudinal supports are inserted into the I-frame in the oblique position, in order to produce a formwork grate (FIG. 7), then the formwork grate is swung up (FIG. 8) and supported with two further formwork props (FIG. 9).

In this embodiment, the formwork frame 12 is likewise first attached to the first formwork prop 2 in the inclined intermediate position (FIG. 6).

Figure 7:
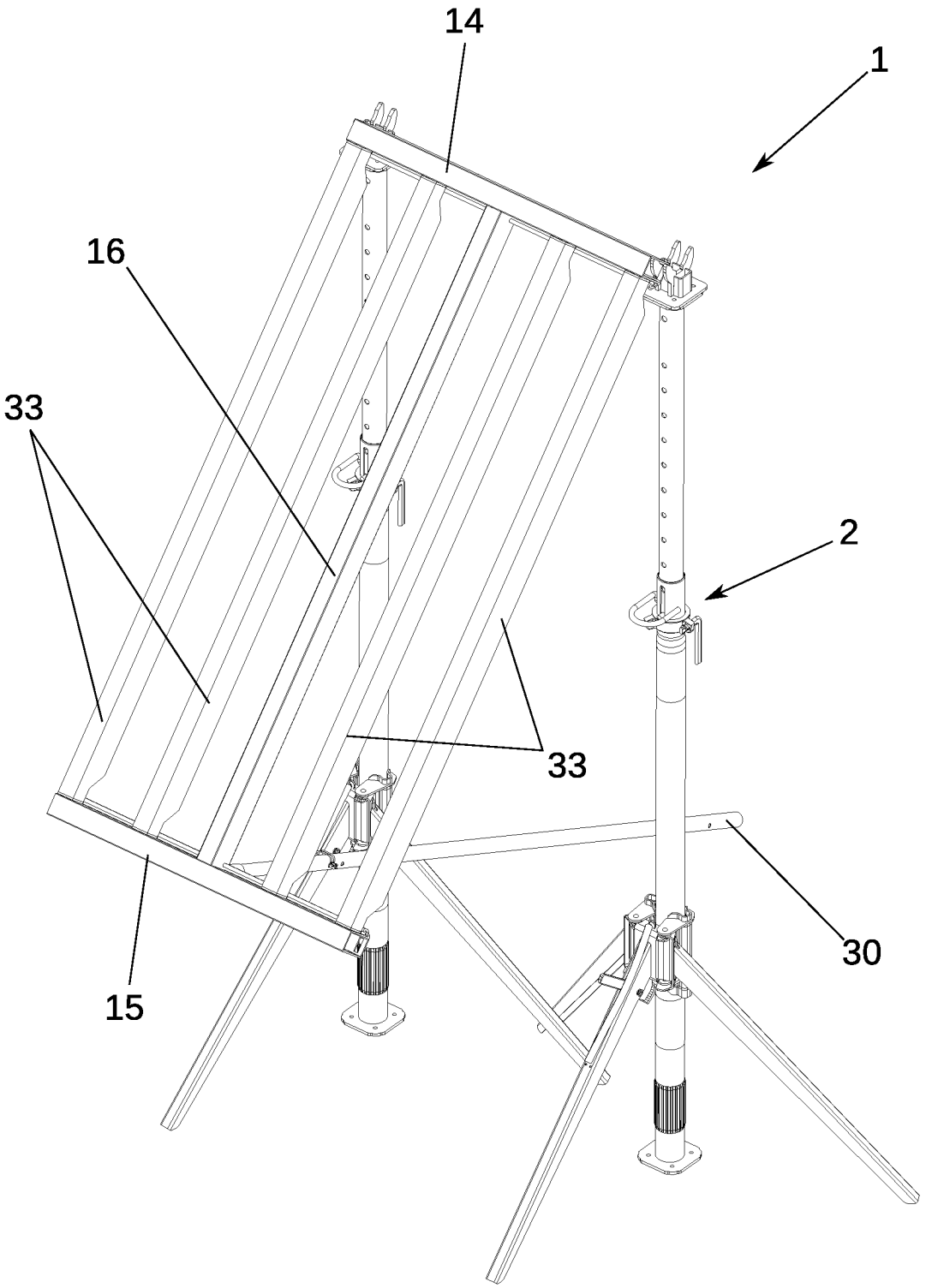
Figure 8:
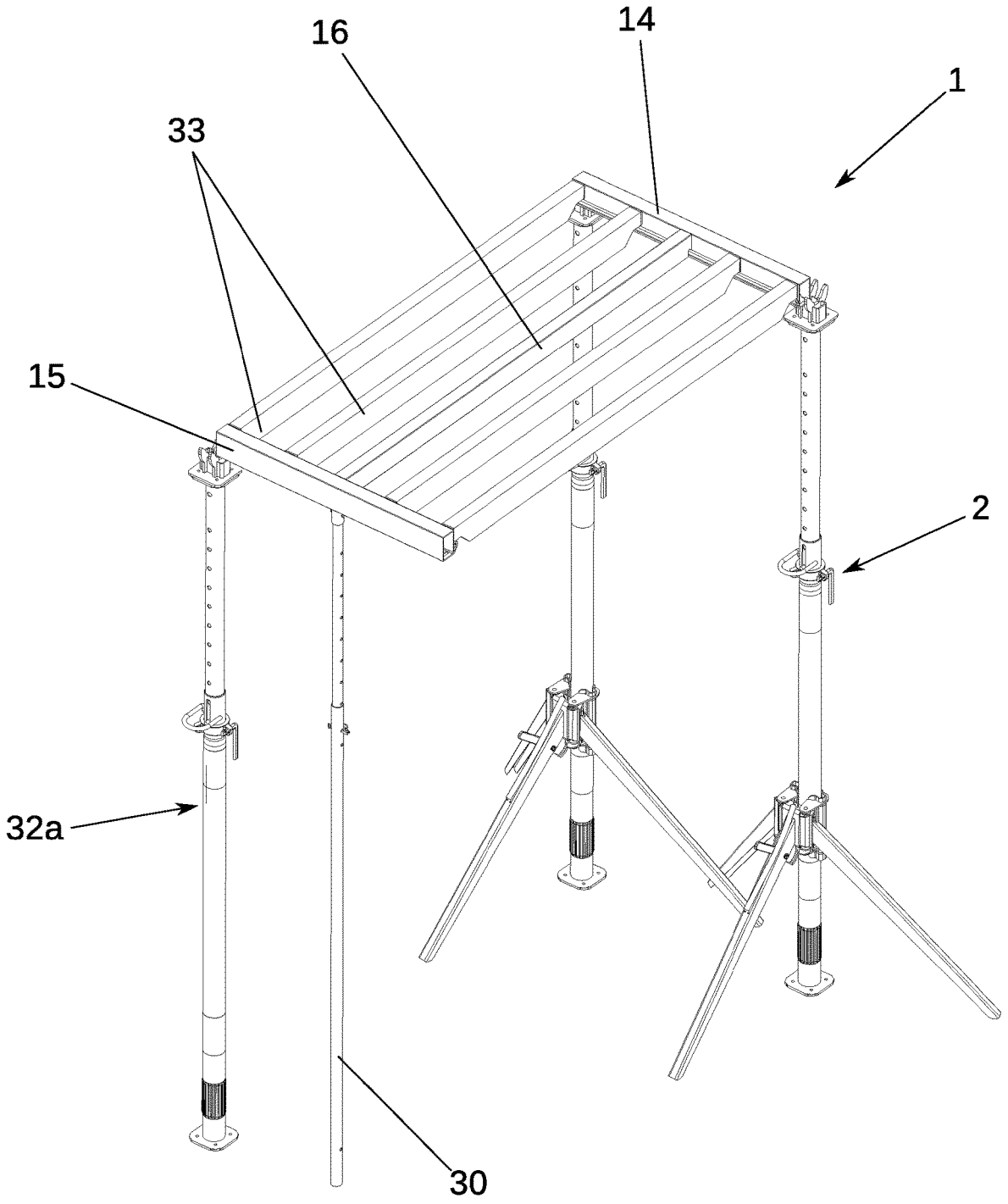
Figure 9:
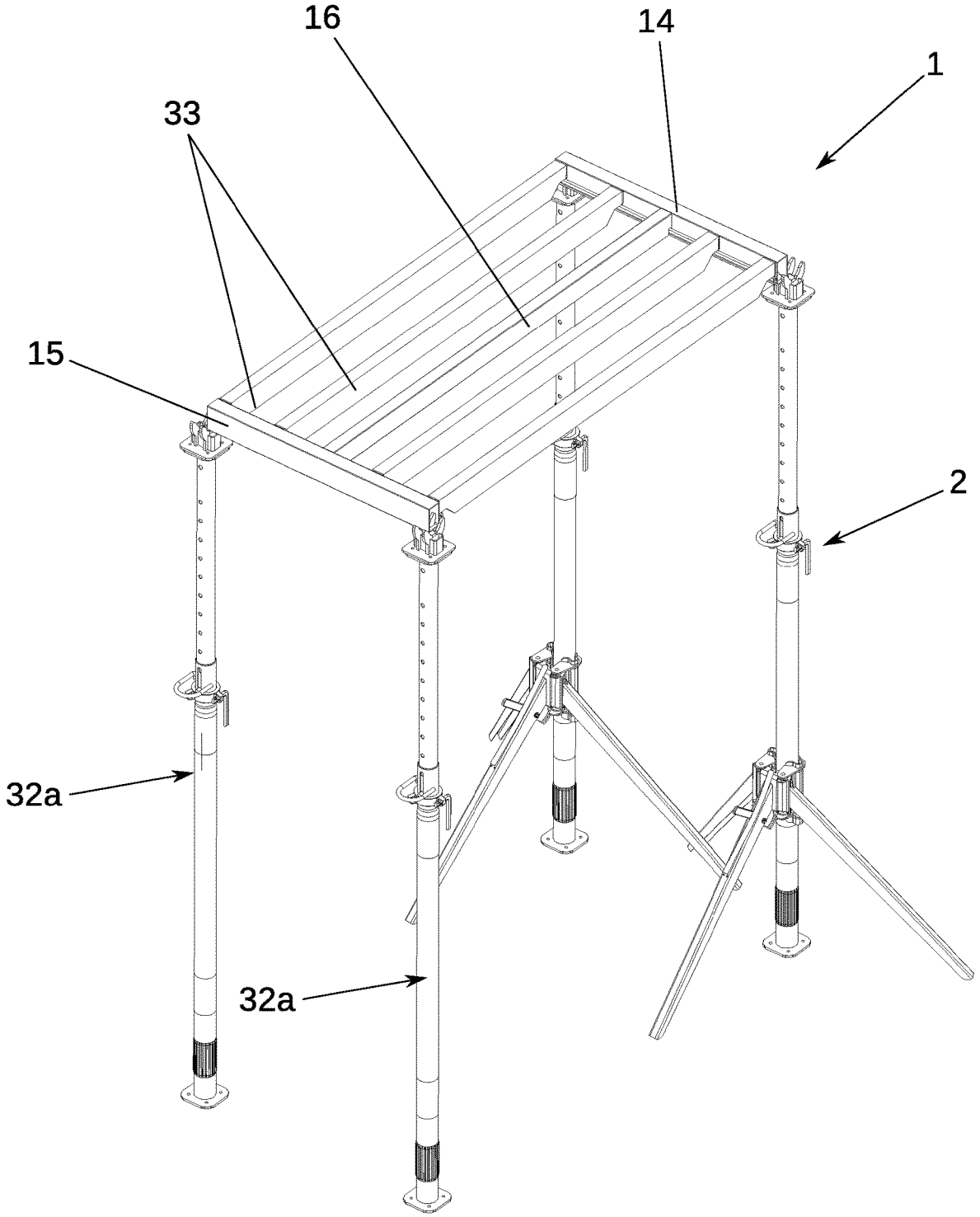

As can be seen in FIG. 7, longitudinal supports 33 are then connected to the formwork frame 12. To this end, the longitudinal supports 33 have, at the ends, hook elements 33*a* (cf. FIG. 18), which are hooked into the first receiving groove 25 on the first cross-support 14 and in the second receiving groove 26 on the second cross-support 15. In the embodiment shown, two longitudinal supports 33 are provided on both sides of the connecting piece 16 of the formwork frame 12.

The formwork element 13 is swung up into the use position (FIG. 8) and supported with the second formwork prop (FIG. 9) as in the embodiment of FIGS. 1 to 5.

Figure 10:
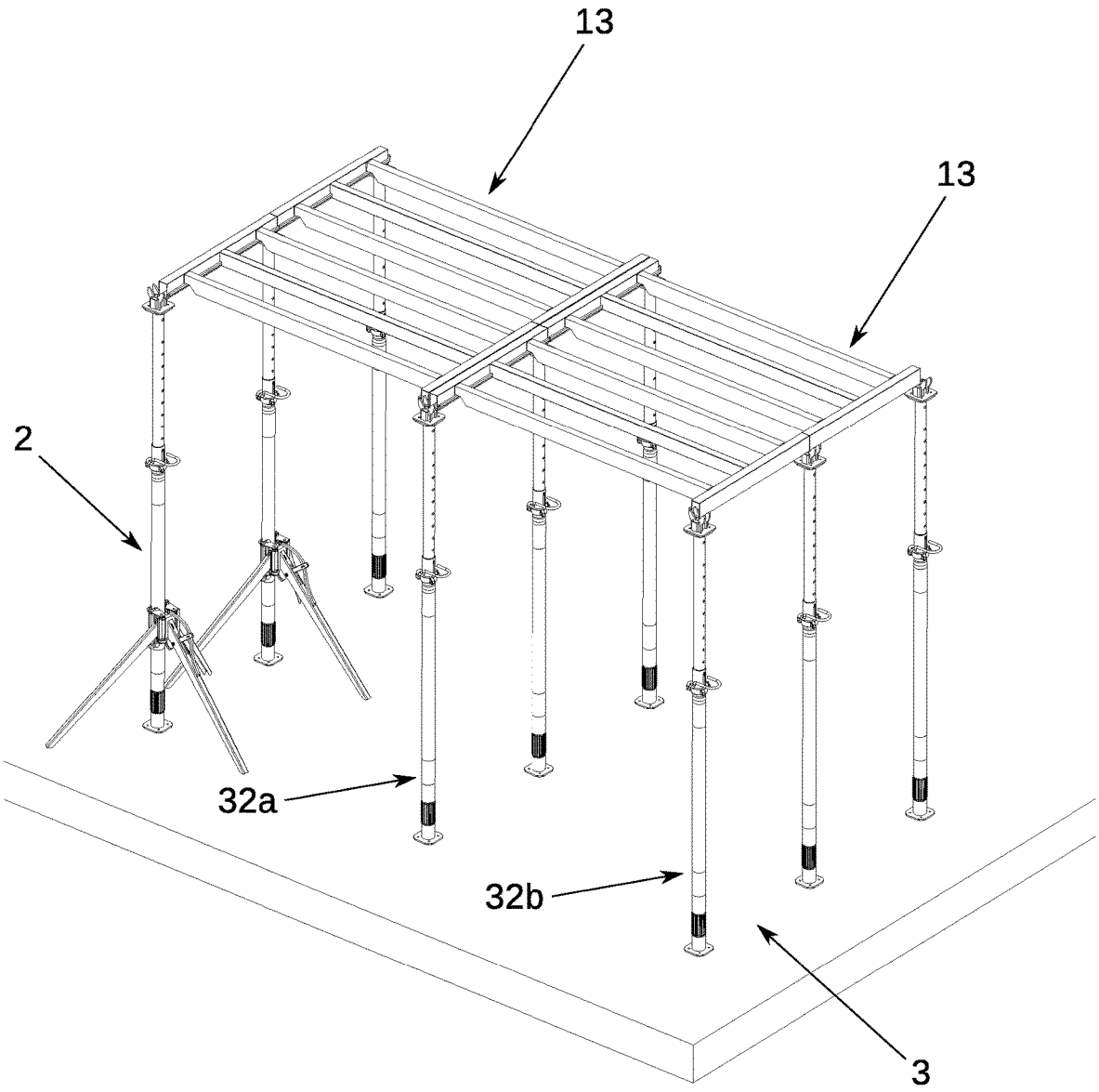
FIG. 10 shows a further ceiling formwork having four formwork elements according to FIG. 9 in the concreting position, each formwork element being formed by an I-frame with two further longitudinal supports.

As can be seen in FIG. 10, the ceiling formwork 1 can have multiple, for example four, formwork elements 13. Formwork boards 34 (cf. FIG. 12), which are not shown in FIG. 10, can then be laid on the formwork elements 13. The tops of the formwork boards 34 form the formwork lining of the ceiling formwork 1.

Figure 11:
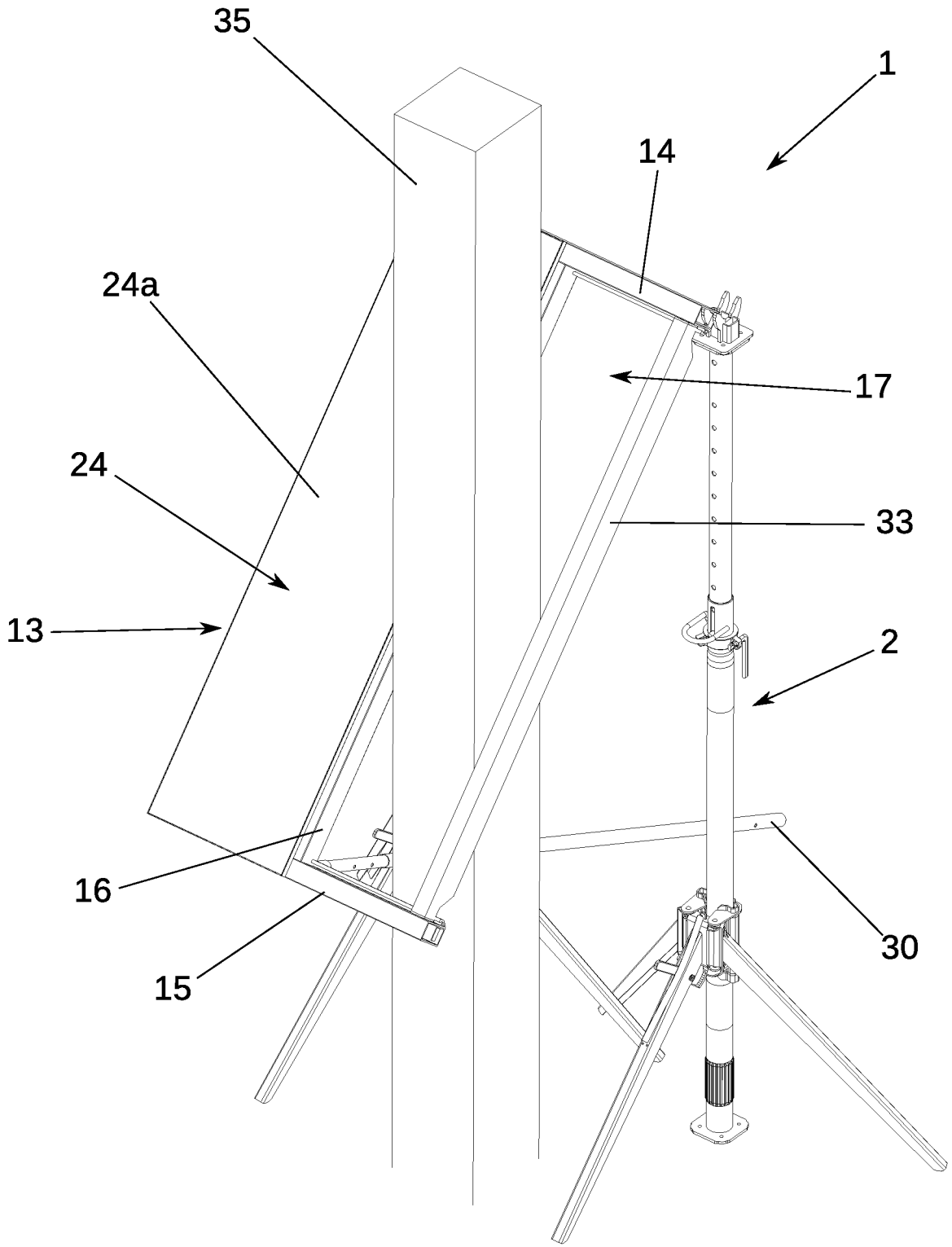
FIG. 11 shows a preferred application of the ceiling formwork for building around an obstacle, in this case a concrete pillar, which is inserted into a lateral recess of the I-frame, before the lateral recess of the I-frame is closed by a longitudinal support.

FIG. 11 shows a preferred application of the ceiling formwork 1 for cutting out an obstacle, in this case a concrete pillar 35. In the inclined intermediate position of the formwork frame 12, the concrete pillar 35 is received in the first lateral recess 17 of the I-frame 12, before a longitudinal support 33 is arranged on the side of the pillar 35 facing away from the connecting piece 16. In the embodiment shown, the second lateral recess 18 is closed by a panel element 24. However, at least one further longitudinal support 33 can alternatively be arranged in the second recess 18, as shown in FIG. 7.

Figure 12A:
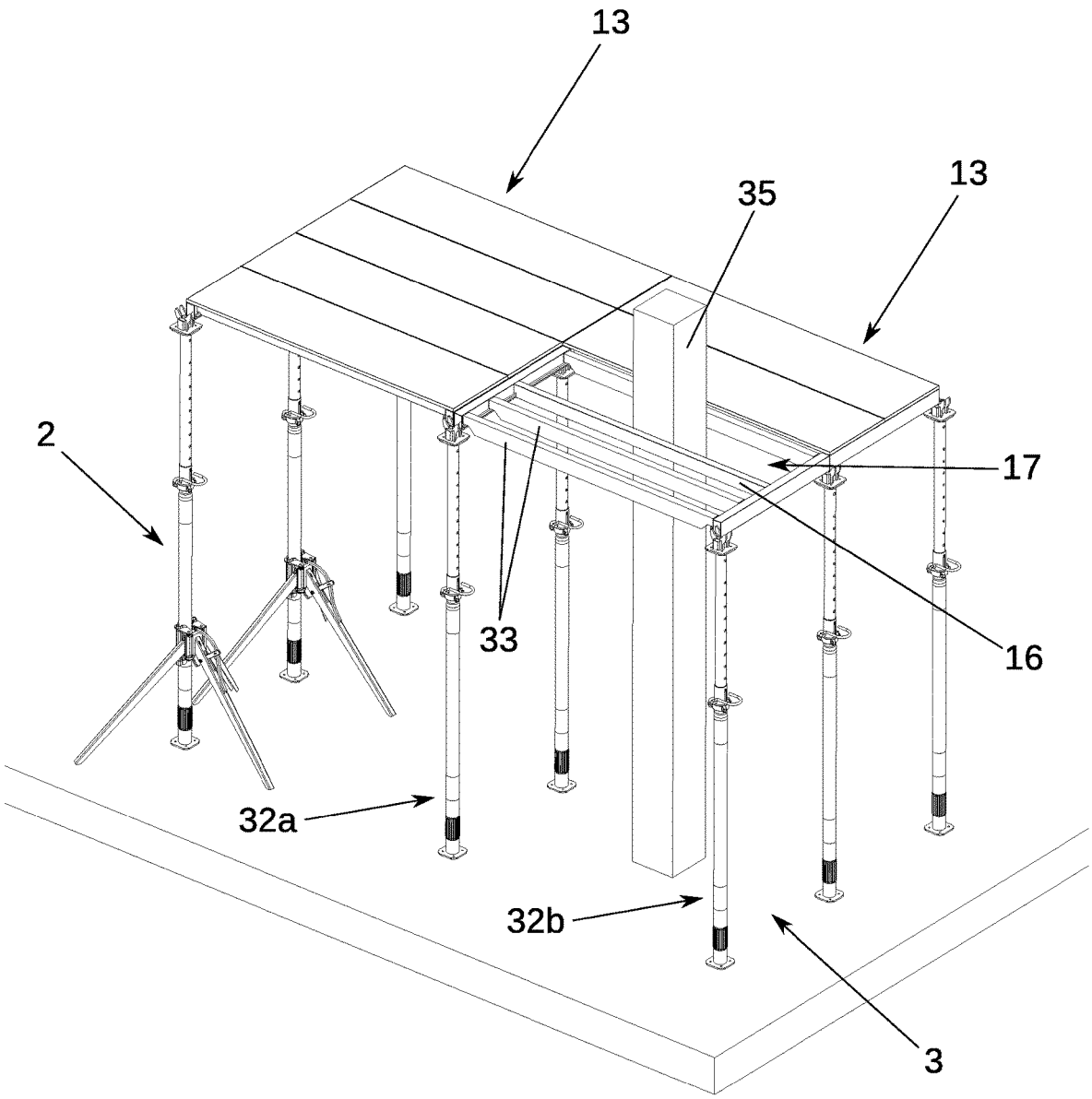
FIG. 12*a* shows a ceiling formwork having four formwork elements, in which three formwork elements are formed according to FIG. 5 with panel elements, and one formwork element is formed with longitudinal supports according to FIG. 10 to build around a concrete pillar.

FIG. 12*a* shows the ceiling formwork 1 by way of example with four formwork elements 13, in which three formwork elements 13 are formed according to FIG. 5 with panel elements 24, and the fourth formwork element 13 is formed with longitudinal supports 33 according to FIG. 11 to build around the concrete pillar 35. Formwork boards which have been cut to size (not shown in FIG. 12*a*) are then laid on the longitudinal supports 33 to complete the formwork top.

Figure 12B:
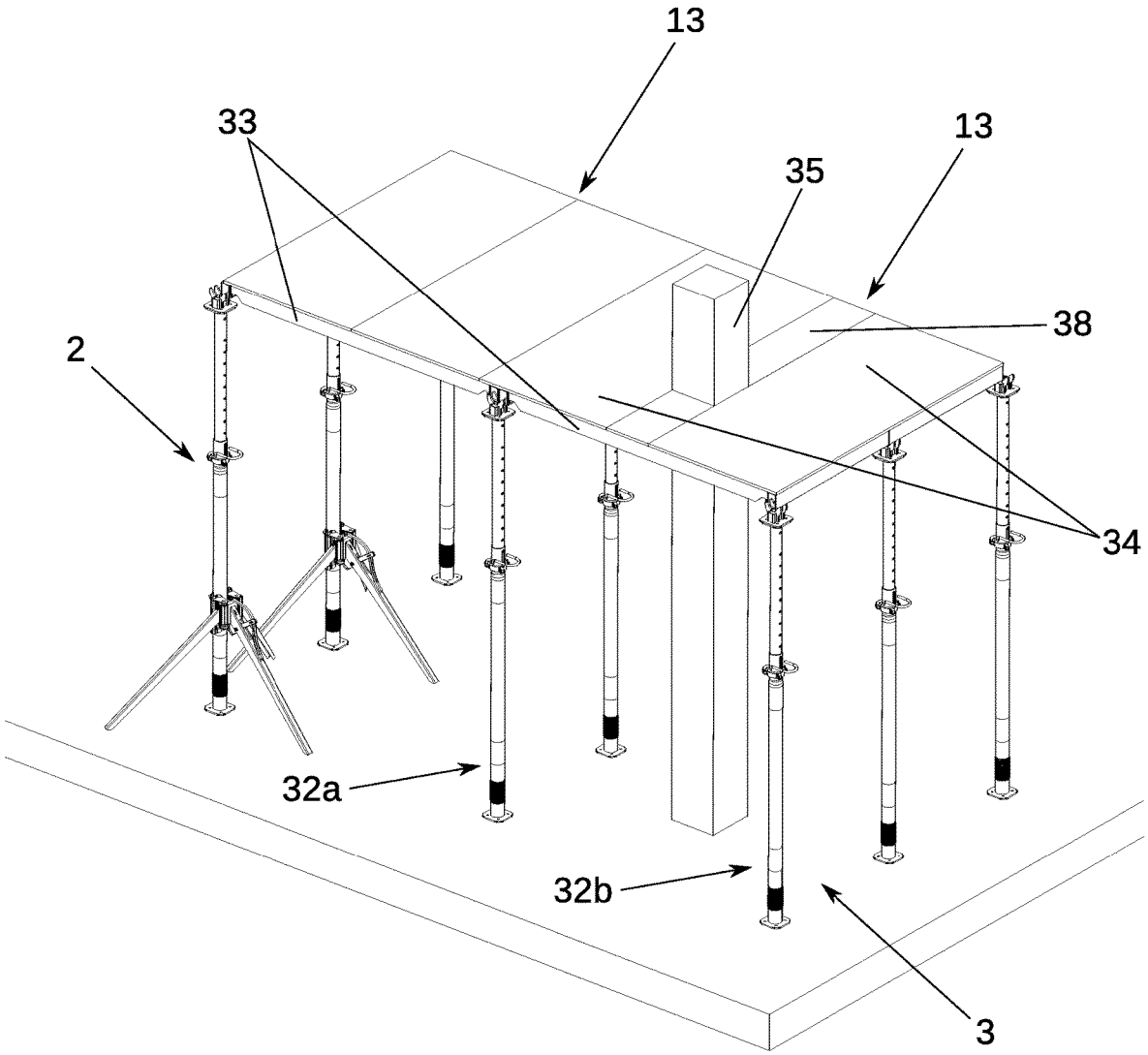
FIG. 12*b* shows a ceiling formwork having four formwork elements consisting of I-shaped formwork frames with longitudinal supports accommodated therein, on which are arranged standard formwork boards on one side and formwork boards 38 cut to size in the region of a pillar on the other side.

FIG. 12*b* shows an alternative embodiment in which the formwork elements are constructed with longitudinal supports 33, which are provided with standard formwork boards 34 on the other side of the pillar 35 and formwork boards 38 which have been cut to size in the region of the pillar 35.

Figure 13:
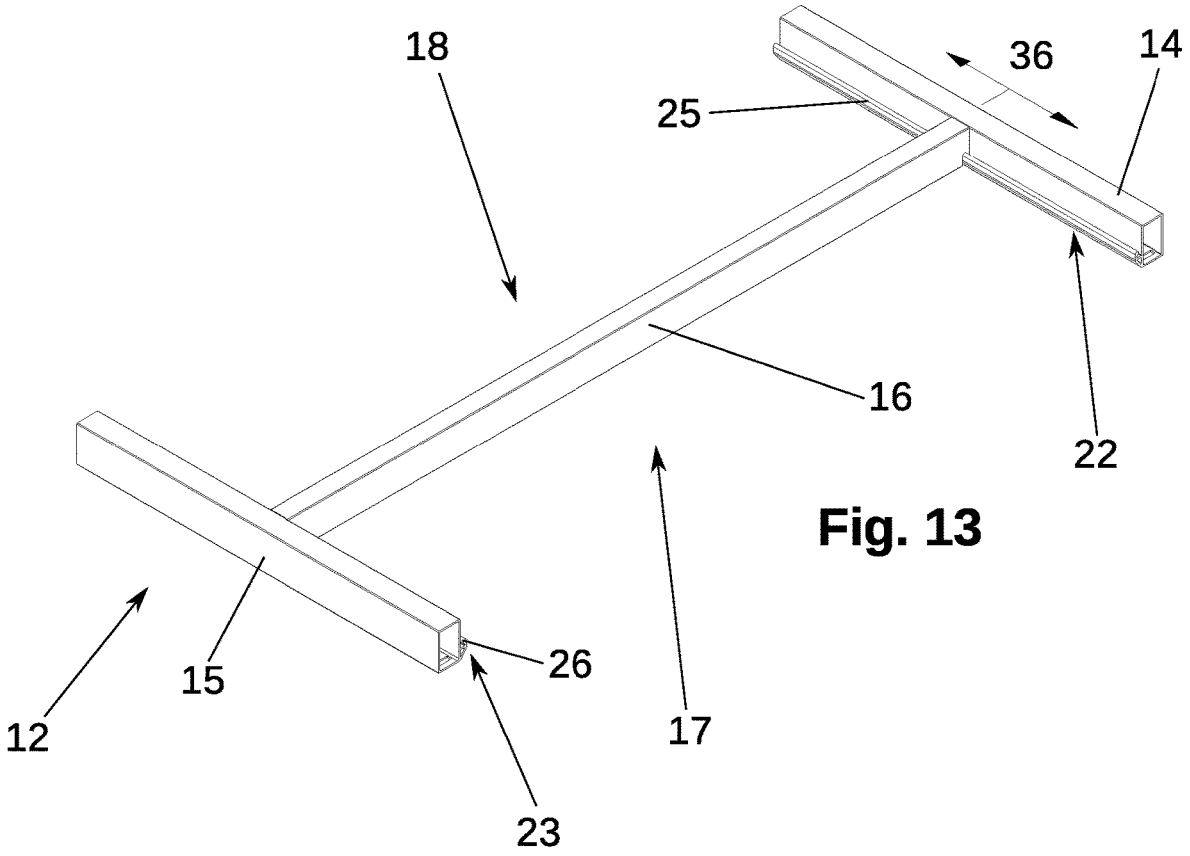
FIG. 13 shows an I-frame according to the invention having a first cross-support, a second cross-support, and a connecting piece which connects the first cross-support to the second cross-support and, in the variant shown, is displaceable in the transverse direction.
Figure 14:
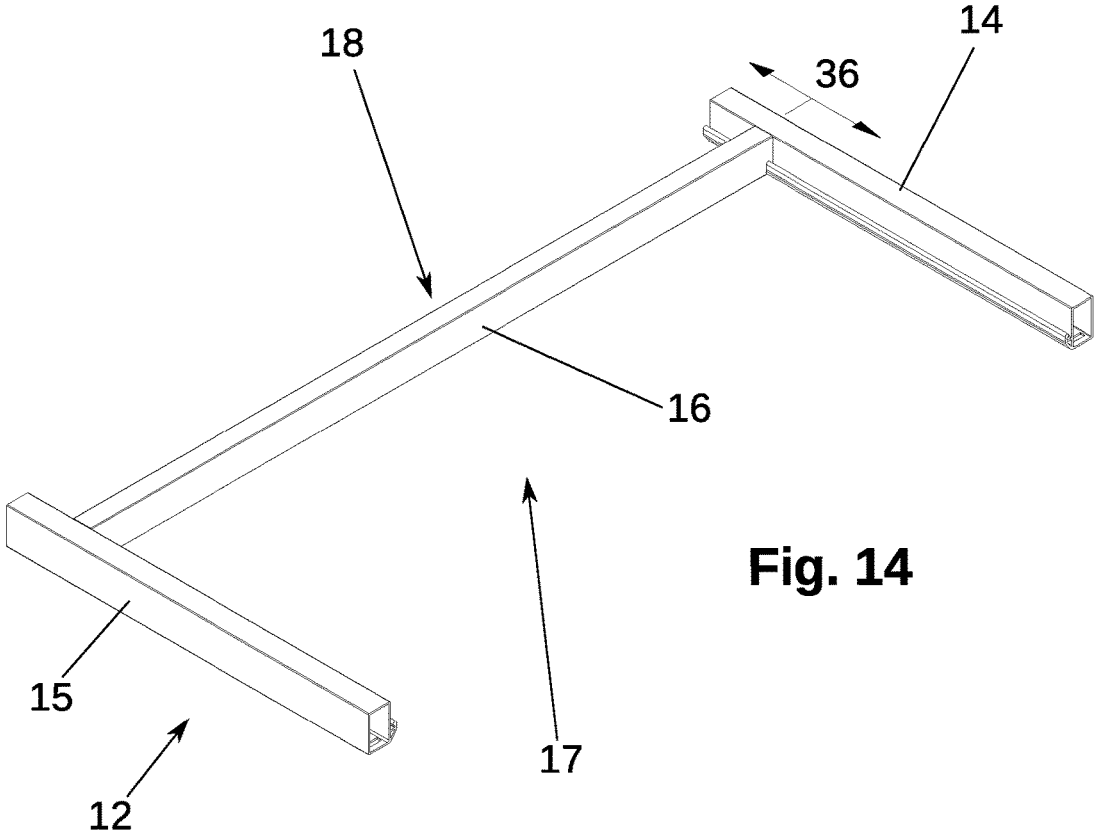
FIG. 14 shows the I-frame of FIG. 13, with the connecting piece shifted to one longitudinal side of the I-frame.

FIGS. 13 and 14 show a further embodiment of the formwork frame 12 in which the connecting piece 16 is displaceable in the transverse direction 36 (i.e. in the longitudinal direction of the first cross-support 14 and the second cross-support 15).

FIG. 13 shows the connecting piece 16 in a central position in which the first lateral recess 17 and the second lateral recess 18 have substantially the same extent along the formwork lining plane.

According to FIG. 14, the connecting piece 16 has been shifted from the central position into an end position closer to one longitudinal side than the other longitudinal side of the formwork frame 12. As a result, the first lateral recess 17 has a larger horizontal extent than the second lateral recess 18. However, the second lateral recess 18 does not disappear completely.

FIGS. 15*a*, 15*b* and 16 each show a further embodiment of the formwork frame 12, the connecting piece 16 in this embodiment being formed by a double piece 37 consisting of two parallel piece elements 37*a*, 37*b*. However, the distance between the piece elements 37*a*, 37*b* is smaller, in particular smaller by a multiple, than the width of the first recess 17 and the second recess 18 (i.e. their extent in the longitudinal direction of the first cross-support 14 and the second cross-support 15), so that the I-shape of the formwork frame 12 is retained.

Figure 17:
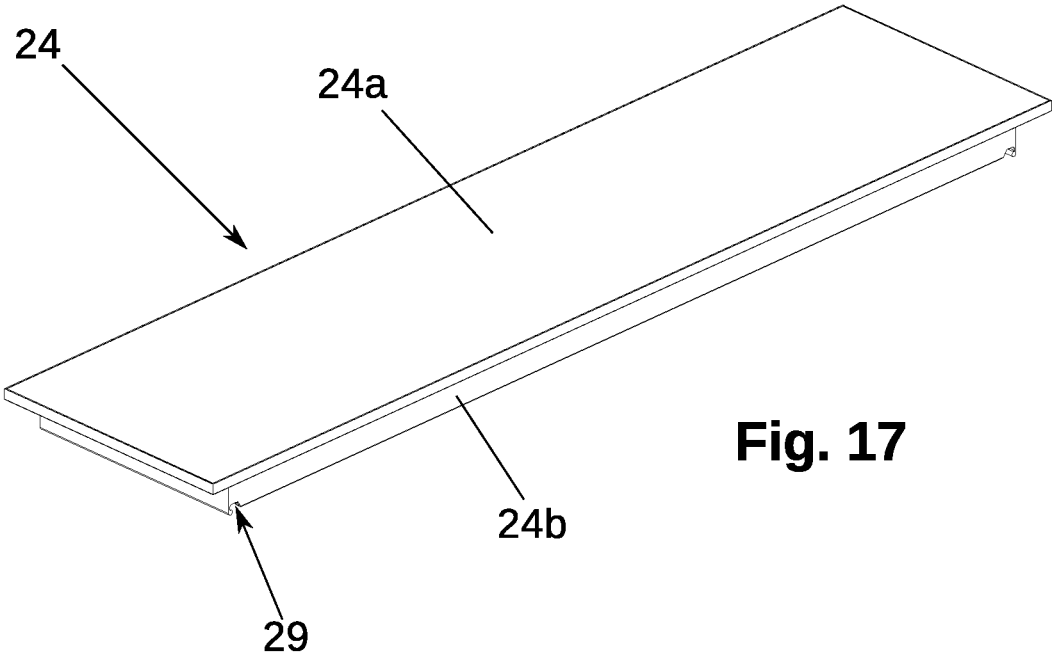
FIG. 17 shows a panel element for hooking into the I-frame according to the invention.

FIG. 17 shows the panel element 24 for hooking into and removal from the formwork frame 12 of the formwork element 13.

Figure 18:
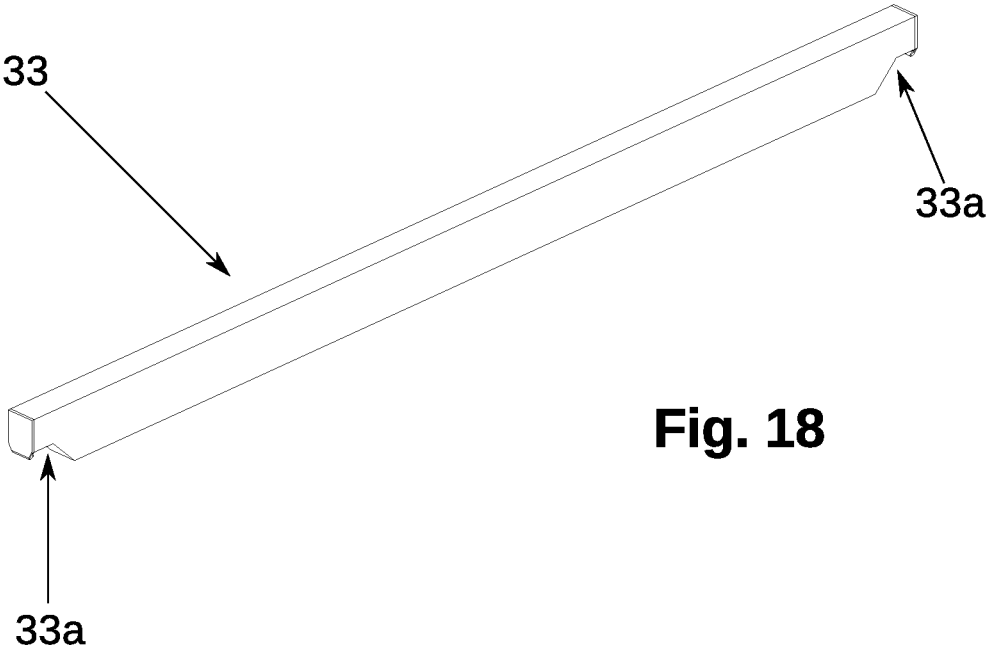
FIG. 18 shows a longitudinal support for hooking into the I-frame according to the invention.

FIG. 18 correspondingly shows the longitudinal support 33 for hooking into and removal from the formwork frame 12.

The invention claimed is:

1. A method for constructing a ceiling formwork for producing a ceiling element, comprising:

arranging two first ceiling props on a floor, providing a formwork frame having:

a first cross-support, a second cross-support, a connecting piece which is longer than the first cross-support and the second cross-support, and which is arranged substantially perpendicular to the first cross-support and the second cross-support, and which connects the first cross-support to the second cross-support, a first unobstructed lateral recess on one longitudinal side of the formwork frame, and a second unobstructed lateral recess on an opposite longitudinal side of the formwork frame, connecting the first cross-support of the formwork frame to the two first ceiling props, the first cross-support having two first retainers for detachable connection to the two first ceiling props, the formwork frame being arranged in an intermediate position inclined downwards from the first cross-support along the connecting piece in a direction of the second cross-support, arranging at least one of (a) at least one panel element and (b) at least one longitudinal support on the formwork frame in the intermediate position to obtain a formwork element such that said at least one of the at least one panel element and the at least one longitudinal support is detachably engaged with the first and second cross-support in the intermediate position;

swinging the formwork element up from the intermediate position into a substantially horizontal use position, and supporting the second cross-support of the formwork frame of the formwork element with two second ceiling props.

2. The method according to claim 1, wherein when the formwork element is arranged in the intermediate position, an obstacle, is arranged within the first lateral recess or within the second lateral recess of the formwork frame.

3. The method according to claim 1, wherein the connecting piece is connected to the first cross-support and the second cross-support displaceably in a transverse direction.

4. The method according to claim 1, wherein the connecting piece comprises two parallel pieces.

5. The method according to claim 1, wherein the at least one panel element consists of exactly two identical panel elements arranged on the formwork frame to form a rectangular formwork top.

6. The method according to claim 1, wherein the at least one longitudinal support is arranged on each side of the connecting piece to support a formwork board.

7. The method according to claim 1, wherein at least one of the first cross-support has a first receptacle and the second cross-support has a second receptacle for detachable connection to at least one of the panel element and the longitudinal support in the intermediate position of the formwork frame inclined downwards from the first cross-support along the connecting piece in the direction of the second cross-support.

8. The method according to claim 7, wherein at least one of the first receptacle has a first receiving groove and the second receptacle has a second receiving groove.

9. The method according to claim 8, wherein at least one of the first receiving groove extends substantially in a direction of a longitudinal axis of the first cross-support and the second receiving groove extends substantially in a direction of a longitudinal axis of the second cross-support.

10. The method according to claim 8, wherein at least one of the first receiving groove has a first undercut and the second receiving groove has a second undercut for engagement with a hook element of at least one of the panel element and the longitudinal support.

11. The method according to claim 10, wherein at least one of the first cross-support has a first retainer for detachable connection to one of the first ceiling props and the second cross-support has a second retainer for detachable connection to one of the second ceiling props.

12. The method according to claim 11, wherein at least one of the first retainer has a retaining protrusion or a retaining opening for connection to one of the first ceiling props and the second retainer has a retaining protrusion or a retaining opening for connection to one of the second ceiling props.

* * * * *